US005511679A

United States Patent [19]

Beck

[11] Patent Number: 5,511,679

[45] Date of Patent: Apr. 30, 1996

[54] CLOSURE FOR RESEALABLE CONTAINER

[75] Inventor: James M. Beck, Buffalo Grove, Ill.

[73] Assignee: Creative Packaging Corp., Buffalo Grove, Ill.

[21] Appl. No.: 427,567

[22] Filed: Apr. 24, 1995

[51] Int. Cl.[6] ..... B65D 17/34

[52] U.S. Cl. ..... 220/270; 220/276; 220/306; 220/352; 215/256; 215/320; 215/354

[58] Field of Search ..... 220/269, 270, 220/276, 306, 307, 352, 317, 320, 354; 215/256

[56] References Cited

U.S. PATENT DOCUMENTS

| | | | |
|---|---|---|---|
| 3,682,706 | 7/1987 | DeVore et al. | 220/276 |
| 3,831,798 | 8/1974 | Rowe et al. | 220/276 X |
| 4,037,748 | 7/1977 | Stubbs, Jr. | 215/256 |
| 4,322,010 | 3/1982 | Curry . | |
| 4,385,708 | 5/1983 | Curry . | |
| 4,467,938 | 8/1984 | Allen . | |
| 4,669,630 | 6/1987 | Kenyon, 2nd | 220/276 |
| 5,020,686 | 6/1991 | Dutt . | |
| 5,085,339 | 2/1992 | Roth et al. . | |
| 5,145,085 | 9/1992 | Yost . | |
| 5,224,616 | 7/1993 | Crisci | 215/256 |
| 5,284,265 | 2/1994 | Crisci | 220/276 X |

FOREIGN PATENT DOCUMENTS

| | | | |
|---|---|---|---|
| 1386141 | 3/1975 | United Kingdom | 215/256 |

*Primary Examiner*—Allan N. Shoap
*Assistant Examiner*—Stephen Cronin
*Attorney, Agent, or Firm*—Silverman, Cass & Singer, Ltd.

[57] ABSTRACT

A resealable container closure including a cap and a tear band formed therewith for engagement with the external wall of the container. A depending flange formed on the underside of the cap engages the internal wall of the container to form a plug seal therewith. Removal of the tear band permits separation of the cap from the container, but re-sealing therewith upon re-engagement of the plug seal with the internal wall of the container.

10 Claims, 3 Drawing Sheets

CLOSURE FOR RESEALABLE CONTAINER

BACKGROUND OF THE INVENTION

1. Field of the Invention

This invention relates generally to closures for resealable containers, and more particularly, to such a closure having a cap and a breakaway tamper evident band formed with the cap.

2. Description of the Prior Art

Tamper evident closures for containers may consist of a cap secured to the top of the container by a separable portion such that the user can open the container by separating the cap from the top. Once the cap is separated, the user will recognize that the container has been opened.

One such tamper evident closure is described in U.S. Pat. No. 4,467,938 in which a peripherally-scored cap is removable from its associated container by pulling a tab secured to the cap thereby separating the cap from the wall of the container to which the cap initially is affixed along the score line. Such closure is not resealable after the cap has been separated from the container.

In many instances, it is desirable to re-close the container in sealing configuration after the cap is removed and the container has been opened. One such re-closable container is described in U.S. Pat. No. 5,020,686 in which a cap is removable from the container by pulling on a tab. After the cap is removed, it can be turned over and pressed back onto the container opening with an annular skirt on the cap engaging an annular rib on the circumferential interior wall of the container.

Another re-closable container is described in U.S. Pat. No. 5,145,085 in which the cap is peripherally scored radially inwardly of a tubular wall of the container and the container wall is provided with a radially inwardly projecting flange. The cap is separable from the container wall by pulling on a tab affixed thereto. The container is reclosable by pressing the separated cap down on the container opening past the inwardly projecting flange to be engaged thereunder. A similar construction is disclosed in U.S. Pat. No. 5,085,339 in which a removable cap is re-engagable with the inwardly-facing side wall of its associated container. The side wall has a lip formed thereon with which the cap can interlock when replaced on the container.

U.S. Pat. Nos. 4,322,010 and 4,385,708 disclose yet another re-closable container in which the cap has a depending skirt engaging the side wall of its associated container. The skirt is partially removable to free the cap from the side wall, and yet re-engage the same by interaction of a locking bead on the cap with a protruding flange on the container wall.

It is desirable to provide a closure for a container which is both tamper evident and resealable with the container upon at least partial removal of a tamper-evident band formed integral with the closure cap.

SUMMARY OF THE INVENTION

The invention provides a closure for a generally cylindrically-shaped container. The closure includes a circular cap having a peripheral band formed integral therewith and engaging the external circumferential surface of the container. A depending flange is formed on the underside of the cap and engages the internal circumferential surface of the container to form a plug seal therewith. A pull tab on the band permits the user to exert a force on the band to separate it from the cap and disengage the cap from the container to permit removal of the contents from the open top thereof. The cap is re-sealable with the container top by re-engaging the plug seal with the internal circumferential surface of the container. Removal of the band evidences that the container has been opened. Separation of the band around the external surface of the container does not disturb the structure of the re-engagable plug seal or any portion of the closure which is located in-bound of the plug seal so as to permit re-sealing of the container.

DESCRIPTION OF THE PREFERRED EMBODIMENT

Figure 1:
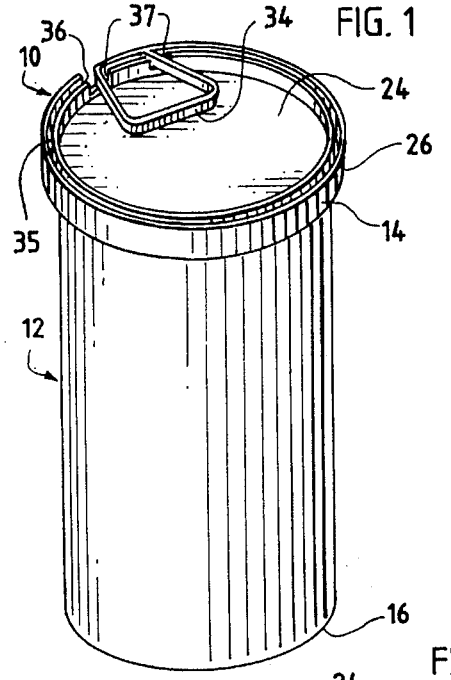
FIG. 1 is a perspective view of a container having the closure of the invention positioned thereon.

Referring to FIG. 1, the closure of the invention is designated generally by the reference numeral 10. The closure 10 typically is utilized in conjunction with a container 12 as will be described below.

Figure 8:
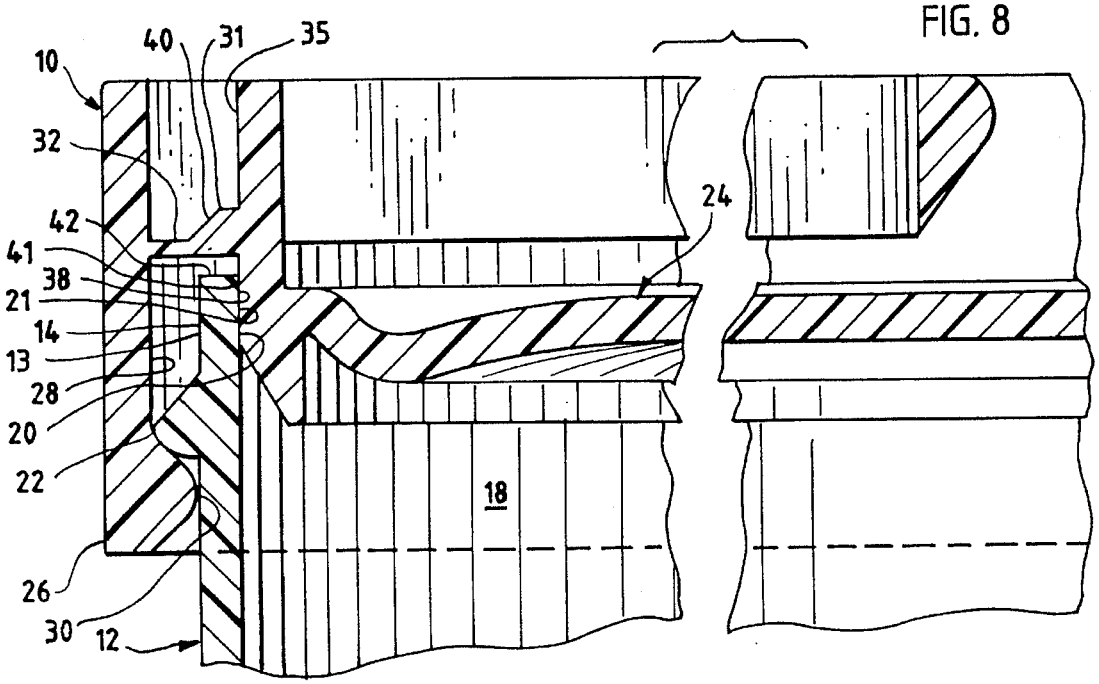
FIG. 8 is a sectional view taken along the line 8—8 of FIG. 7 in the direction indicated generally.
Figure 10:
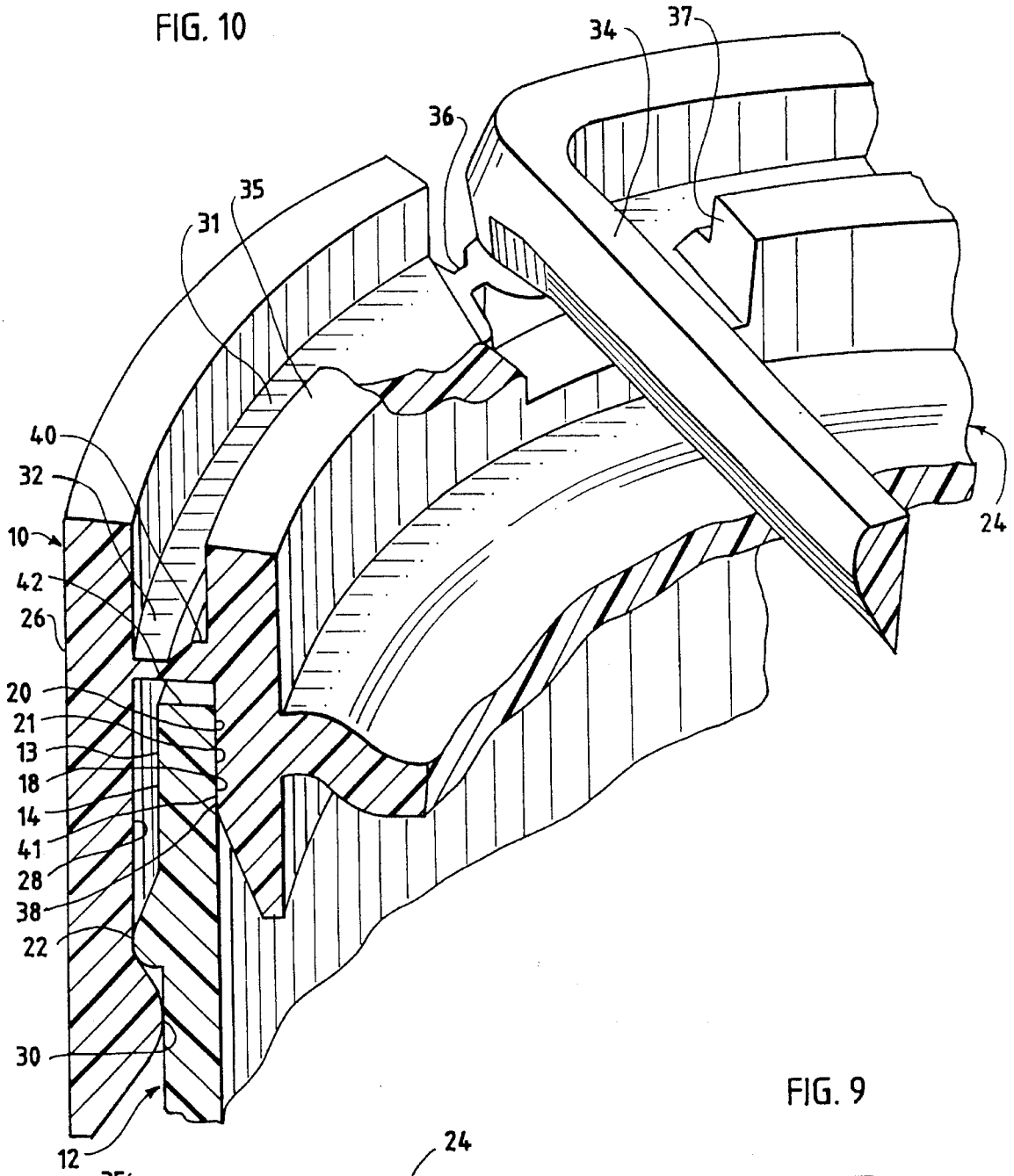
FIG. 10 is an enlarged fragmentary perspective view of the top of the container.

The container 12 preferably is of generally cylindrical configuration having a top end 14 and a bottom end 16. As seen in FIGS. 8 and 10, the container 12 includes an interior portion 18 and the top end 14 has an open mouth 20 which is covered and sealed when the closure 10 is installed thereon.

In order to releasably attach the closure 10 to the container 12, the external circumferential surface 13 of the top end 14 of container 12 preferably includes a projecting ridge 22 formed thereon for snapping engagement with the closure 10. However, the top end 14 also can be designed for threaded screw engagement, if desired. In addition, the ridge 22 can be replaced with a recess formed for snapping engagement with the closure 10. It is to be understood that the shape, size and material of the container 12, the open mouth 20, the top end 14, and the ridge 22, can vary within the contemplation of the present invention.

The closure 10 comprises a cap 24 and a breakaway tamper-evident band 26 formed about the periphery of the cap 24, as will be explained in detail below. Preferably, the closure 10 is formed of plastic. The band 26 has an interior side 28, and the interior side 28 includes an annular rib 30. Preferably, the rib 30 cooperates with the ridge 22 of the external circumferential surface 13 of the top end 14 of the container 12 by engagement therewith to releasably attach the closure 10 to the container 12.

The tamper-evident band 26 is integrally formed about the external periphery of the cap 24 in a breakaway manner and has a predetermined width selected to span the interstice between the cap 24 and the container 12 when the closure 10 is affixed to the container 12. A web 31 is formed between the inner side 28 of band 26 and an upstanding wall 35 formed along the periphery of cap 24 to connect the band 26 to cap 24. Preferably, in order to provide the tamper evident breakaway capability of the band 26, a score line 32 or reduced dimension portion is provided along web 31 between the cap 24 and the band 26 along a substantially circular path. The score line 32 can be formed as spaced indentations or perforations, if desired.

It is to be noted that the cap 24 and band 26 provide a closure 10 which is of substantially continuous circular configuration and is generally aesthetically pleasing in appearance. Removal of the band 26 by anyone other than an authorized user will clearly indicate that the container 12 has been tampered with. The band 26 is not replaceable after it has been removed.

Figure 3:
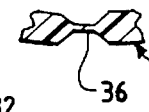
FIG. 3 is a sectional view taken along the line 3—3 of FIG. 2 in the direction indicated generally.
Figure 7:
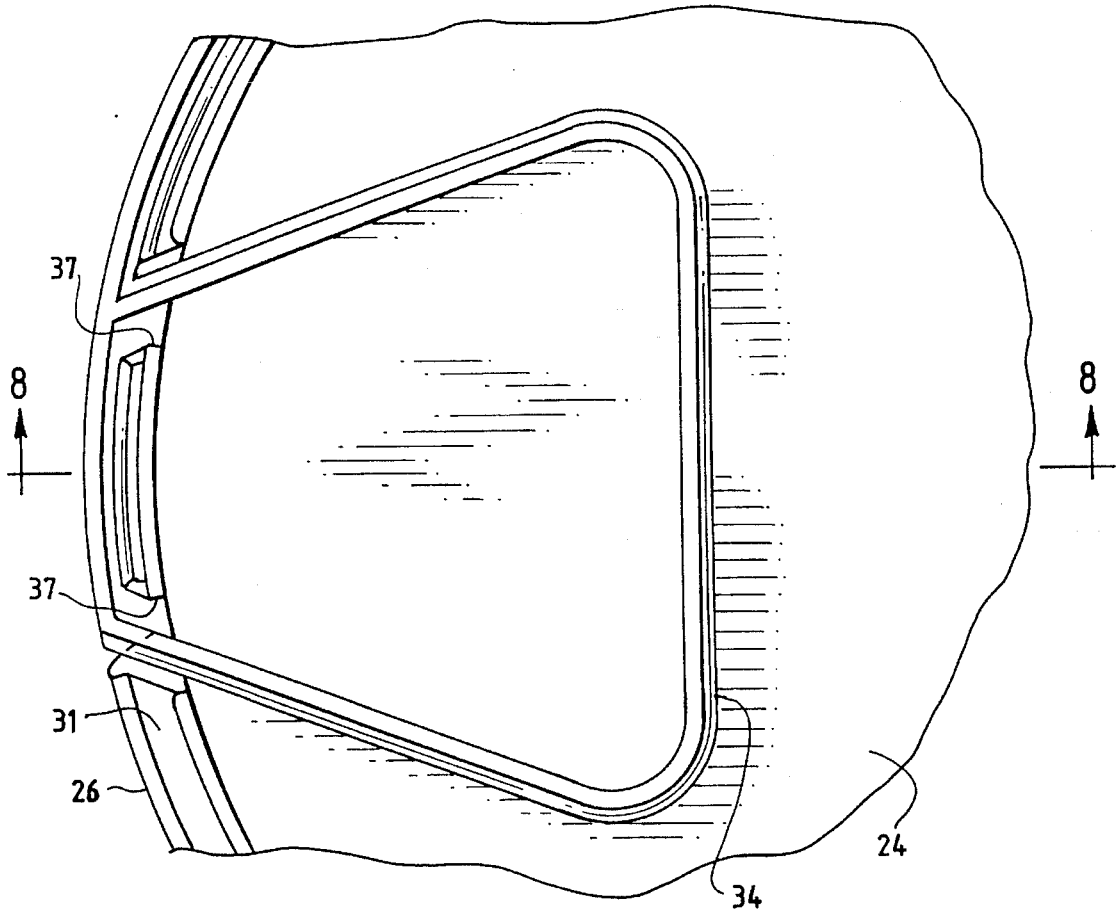
FIG. 7 is a fragmentary enlarged plan view of the cap and peripheral band with tear tab of the invention.

As FIGS. 1, 2, 4, and 5 illustrate, in order to assist a consumer in removing the band 26, a tear tab 34 is included about a portion of the band 26. Initially, the tear tab 34 extends over the cap 24 and upstanding wall 35 of the cap 24 is provided with gaps 37 to accommodate the tear tab 34. It should be appreciated that there are other readily available alternatives to the type of tear tab described herein. The tear tab 34 is formed at a readily severable score line 36 on the band 26. It should be appreciated that there are alternatives to the score line 36 such as a perforation or a gap in the band 26. FIG. 3 illustrates the score line 36 of the band 26 in a sectional view. FIG. 7 illustrates a portion of the band 26 and the tear tab 34 as it extends over the cap 24 before the tear tab 34 is pulled to separate the band 26 from the cap 24.

Figure 5:
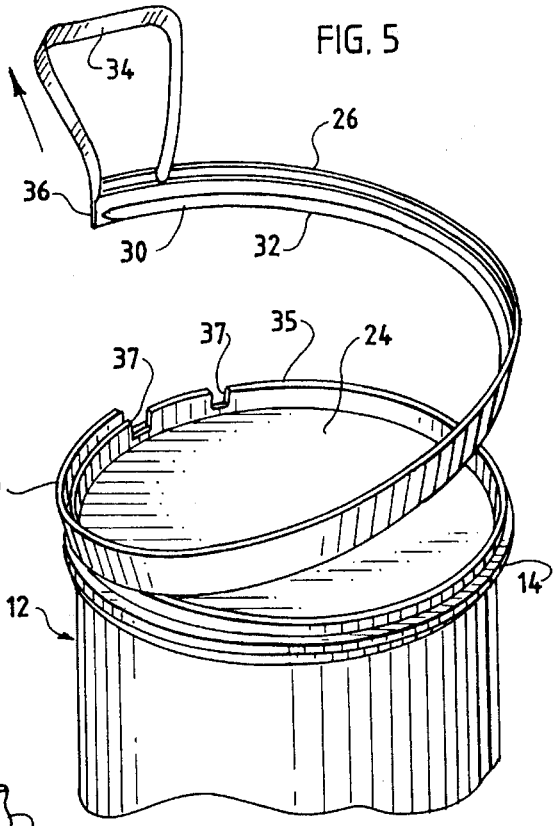
FIG. 5 is a view similar to that of FIG. 4 illustrating the closure in a subsequent stage of separation of the band.
Figure 2:
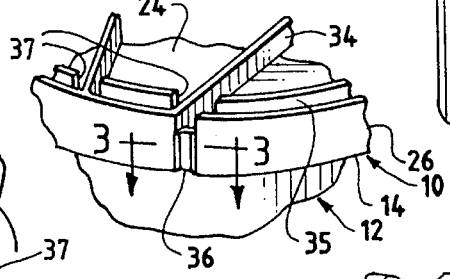
FIG. 2 is an enlarged fragmentary perspective view showing the tear tab of the closure.
Figure 4:
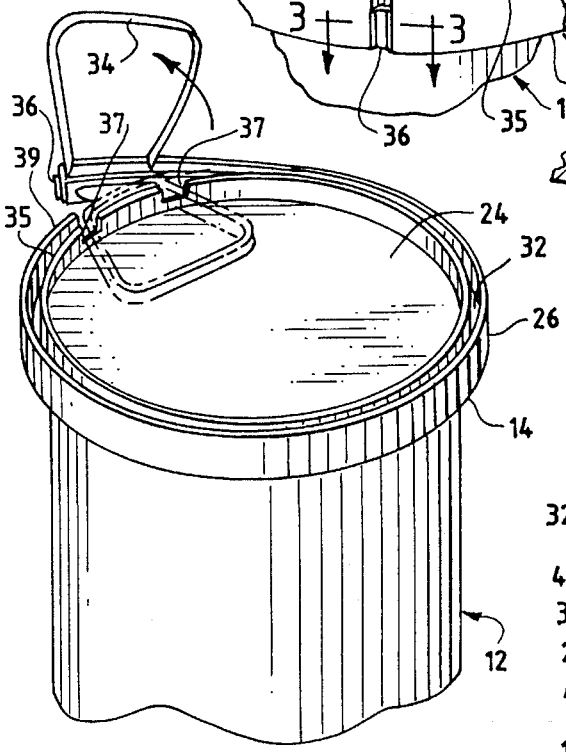
FIG. 4 is an enlarged perspective view of the top portion of the container illustrating the closure in its initial stage of separation of the peripheral band from the external wall of the container.

The operation of the assembly is illustrated in FIGS. 4 and 5. Removal of the band 26 from the cap 24 is initiated by a user pulling upwardly on the tear tab 34. This upward force severs the score line 36 on the band 26. The user can then pull the tear tab 34 circumferentially outwardly to sever the band 26 along web 31 about the cap 24 and along the circular score line 32 between the cap 24 and the band 26.

As FIGS. 8 and 10 illustrate, the cooperation between the ridge 22 of the external circumferential surface 13 of the top end 14 of the container 10 and the annular rib 30 of the interior side 28 of the band 26 provides an initial connection between the closure 10 and the container 12. Additionally, the circumference of the band 26 is selected so that it fits snugly against the outside surface of the container 12. It should be appreciated that the band 26 can be heat shrunk in place after the closure 10 is connected to the container 12 to assist in the fit between the band 26 and the container 12. In addition to the initial connection between the closure 10 and the container 12 formed as a result of the cooperation between the ridge 22 of the external circumferential surface 13 of the top end 14 of the container 10 and the annular rib 30 of the interior side 28 of the band 26, a depending flange 38 is provided on the periphery of cap 24 such that when the closure 10 is installed on the container 12, the depending flange 38 abuts the interior 18 of container 12 to form a plug seal 41 with the internal circumferential surface 21 at the top end 14 of the container 12.

To assemble the closure 10 on the container 12, the closure 10 first is positioned over the open mouth 20 of the container 12 which typically is filled with a product. Thereafter, the closure 10 is moved downwardly with a predetermined amount of force to cause the annular rib 30 on the interior side 28 of the band 26 to engage below the ridge 22 on the external circumferential surface 13 of the top end 14 of the container 12, while the internal circumferential surface 21 of the top end 14 of the container 12 rests snugly against the depending flange 38 of the cap 24, thereby forming the plug seal 41.

To remove the closure 10, the tear tab 34 is pulled upwardly to sever the score line 36 on the band 26. Then, the tear tab 34 can be pulled by a user to sever the circular score line 32 about the entire periphery of the cap 24 and remove the band 26, which then can be discarded. Alternatively, a portion 39 of band 26 can be formed to remain connected to cap 24, if desired.

Figure 9:
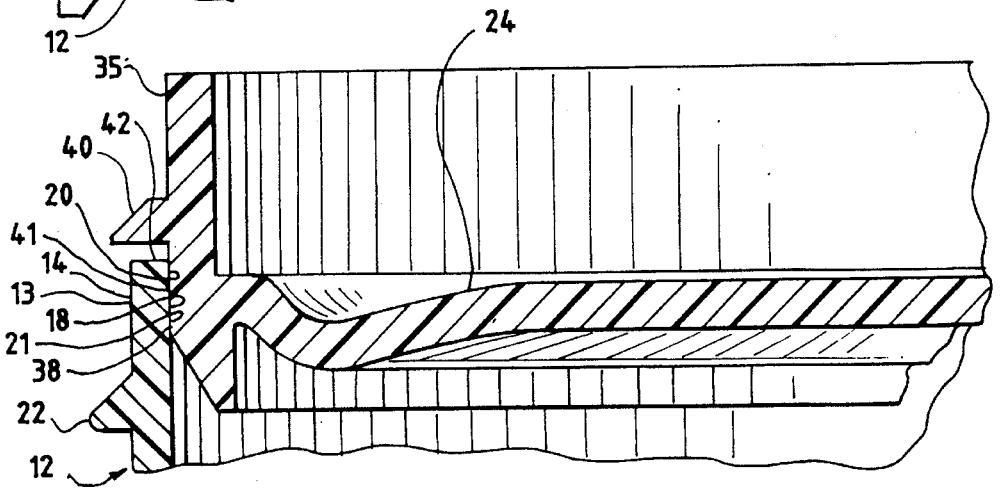
FIG. 9 is an enlarged fragmentary sectional view taken through the top of the container.

As FIG. 9 illustrates, after the band 26 is removed, the cap 24 is engaged over the top end 14 of the container 12 by an extending flange 40 remaining on the periphery of the cap 24 which extends over a top edge 42 of the top end 14 of the container 12. Additionally, after the band 26 is removed, the depending flange 38 of the cap 24 maintains the plug seal 41 formed in cooperation with the internal circumferential surface 21 of the top end 14 of the container 12.

Figure 6:
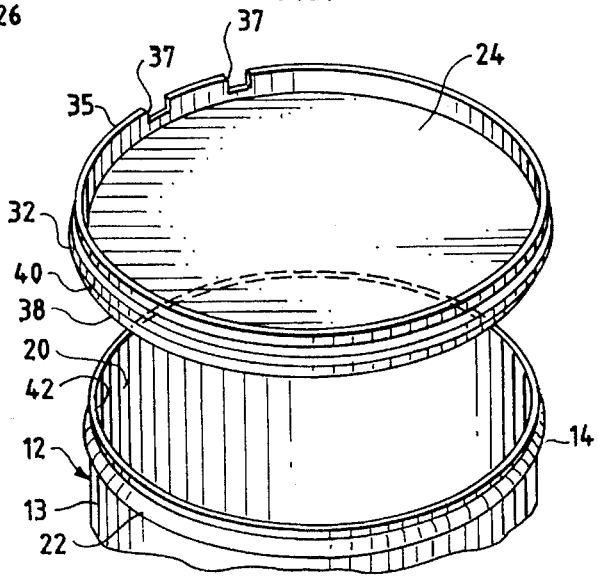
FIG. 6 is an exploded view similar to that of FIGS. 4 and 5 illustrating the closure completely separated from the container after removal of the peripheral band therefrom.

As FIG. 6 illustrates, after the band 26 is separated from cap 24 by severing of the score line 32, the cap 24 can be removed to provide access to the container 12. Thereafter, as FIG. 9 illustrates, the cap 24 without band 26 can be replaced on the container 12 by a user by placing the cap 24 onto the container so that the extending flange 40 of the cap 24 rests on the top edge 42 of the top end 14 of the container 12 with the depending flange 38 of the cap 24 resting against the internal circumferential surface 21 of the top end 14 of the container 12 to re-form the plug seal 41.

It is to be understood that the cap 24 is re-sealable with the container top 14 by re-engaging the plug seal 41 between depending flange 38 and inner portion 18 of container 12. Separation of the band 26 around the external surface 13 of container 12 does not disturb the structure of the re-engagable plug seal 41 or any portion of the closure 10 which is located in-bound of the plug seal so as to permit re-sealing of the container.

What is desired to be secured by Letters Patent of the United States is:

1. A closure for a container having a generally circular cross-sectional configuration, the container having an external and an internal surface, said closure comprising, a circular cap having a periphery, an underside and a top side, a band formed integral with the periphery of the cap, the band having an inner-facing surface and being integrally joined to said cap by means of a web at a location to divide said band into upper and lower portions, means formed between the inner-facing surface of the band at a lower portion thereof and the external surface of the container for cooperative engagement therebetween, a depending flange formed along the periphery of the underside of the cap to be in cooperative engagement with the internal surface of the container, said flange forming a plug seal between the cap and the container when the flange is in engagement with the internal surface of the container, means to separate the band from the cap without disturbing the plug seal, said cap being removable from the container upon separation of the band from the cap but being replaceable upon the container by re-engaging the flange with the internal surface of the container to re-establish the plug seal therebetween; and wherein said means to separate the band from the cap without disturbing the plug seal comprises a tear tab formed on a portion of the band and extending over the cap.

2. A closure as claimed in claim 1 in which said means formed between the inner-facing surface of the band and the external surface of the container for cooperative engagement therebetween comprise an annular rib formed on the inner-facing surface of the band and a ridge formed on the external surface of the container.

3. A closure as claimed in claim 2 in which the rib is engaged below the ridge.

4. A closure as claimed in claim 1 in which said means to separate the band from the cap without disturbing the plug seal further comprise a score line on the band proximate said tear tab, and a circular score line formed on said web positioned between the cap and the band.

5. A closure for a container having a generally circular cross-sectional configuration, the container having an open top and a closed bottom and external and internal surfaces, said closure comprising a cap having an upstanding circular wall with upper, medial and lower portions and external and internal surfaces, a circular plate secured to a lower portion of the inner surface of said circular wall in a fluid tight connection, the external diameter of the lower portion of said circular wall being slightly greater than the internal diameter of said container open top so as to form a plug seal therewith, a web extending circumferentially around an external surface of a medial portion of said circular wall, a circular band having upper, medial and lower portions with external and internal surfaces, said band secured to said web at an internal surface of a medial band portion to lie in closely spaced relationship with said circular wall, interengaging means on an inner surface of a lower band portion and on the external surface of said container for securing said closure to said container, and means to separate the band from said circular wall, said means including a circumferential score line on said web and a tear tab connected to a portion of said band.

6. A closure as claimed in claim 5 in which said tear tab is connected to an upper portion of said band and extends over the cap.

7. A closure as claimed in claim 6 in which said tear tab comprises a generally U-shaped structure with the legs of the U connected to said band, gaps being provided in said upstanding wall allowing passage of the legs of the U over the cap.

8. A closure as claimed in claim 7 in which a band score line is provided across the outer surface of said band adjacent to the connection of the tear tab whereby upward pulling of said tear tab separates the band at the band score line and permits peeling away said band along the web score line without disturbing the plug seal in the container opening.

9. A closure as claimed in claim 5 in which said means for engaging the band with the external circumferential surface of the container comprise an annular rib formed on the lower internal band portion and a ridge formed on the external circumferential surface of the container.

10. A closure as claimed in claim 9 in which the rib is engaged below the ridge.

* * * * *